US010248064B2

(12) United States Patent
Matsuo

(10) Patent No.: US 10,248,064 B2
(45) Date of Patent: Apr. 2, 2019

(54) IMAGE FORMING APPARATUS FOR CONTINUOUSLY EXECUTED PRINTING AND CONTROL PROGRAM

(71) Applicant: Konica Minolta, Inc., Chiyoda-ku, Tokyo (JP)

(72) Inventor: Masahiro Matsuo, Kokubunji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/914,330

(22) Filed: Mar. 7, 2018

(65) Prior Publication Data

US 2018/0299814 A1 Oct. 18, 2018

(30) Foreign Application Priority Data

Apr. 13, 2017 (JP) ..... 2017-080039

(51) Int. Cl.
*G03G 15/00* (2006.01)
*G03G 15/01* (2006.01)
*G03G 21/14* (2006.01)

(52) U.S. Cl.
CPC ..... *G03G 15/5062* (2013.01); *G03G 15/502* (2013.01); *G03G 15/652* (2013.01); *G03G 21/14* (2013.01); *G03G 15/01* (2013.01)

(58) Field of Classification Search
CPC ..... G03G 15/5062; G03G 15/502; G03G 15/652; G03G 21/14; G03G 15/01
USPC ..... 399/72
See application file for complete search history.

(56) References Cited

U.S. PATENT DOCUMENTS 4,249,820 A * 2/1981 Freeman ..... G03B 21/118 355/18
5,566,004 A * 10/1996 Imaizumi ..... H04N 1/3875 358/449
8,363,237 B1 * 1/2013 Withington ..... G06F 3/12 358/1.13
2006/0061824 A1 * 3/2006 Miyachi ..... G03G 15/5095 358/1.18
2012/0002994 A1 * 1/2012 Moroney ..... G03G 15/5016 399/72

FOREIGN PATENT DOCUMENTS

JP 5741656 B2 7/2015

* cited by examiner

*Primary Examiner* — Susan S Lee
(74) *Attorney, Agent, or Firm* — Buchanan Ingersoll & Rooney PC

(57) ABSTRACT

An image forming apparatus includes: a print job acquisitor that acquires a print job; a hardware processor that calculates, before starting printing based on the print job, a distance in a paper conveying direction in which the printing is continuously executed, and in a case where the distance is equal to or greater than a predetermined distance, allows a user to select at least one image as a print image out of a first image generated on the basis of the print job and a second image different from the first image; and a printing part that prints the print image selected by the user on paper.

20 Claims, 14 Drawing Sheets

IMAGE FORMING APPARATUS FOR CONTINUOUSLY EXECUTED PRINTING AND CONTROL PROGRAM

The entire disclosure of Japanese patent Application No. 2017-080039, filed on Apr. 13, 2017, is incorporated herein by reference in its entirety.

BACKGROUND

Technological Field

The present invention relates to an image forming apparatus and a control program.

Description of the Related Art

Conventionally, an image forming apparatus is known capable of printing an image on continuous paper. For example, a so-called roll-to-roll image forming system has been widely used in which an image corresponding to a print job is sequentially printed on paper while pulling out and conveying the paper (hereinafter also referred to as "roll paper") wound in a roll shape as continuous paper, and then the paper is wound again in a roll shape. By using such an image forming system to perform printing on long paper such as the roll paper, it is possible to continuously print multiple images, or to print an image long in a paper conveying direction without dividing the image into multiple sheets of paper.

However, when the image is printed on the long paper, in a case where toner to be used is biased and a specific toner is not consumed for a long time, or in a case where coverage is low, the toner stored in the developing part may be degraded. In a case where the degraded toner is used for printing, there is a possibility that problems such as fogging and toner scattering occur in the printed image.

In relation to this, JP 5741656 B2 discloses an image forming apparatus that forms an image based on image information in the case where the coverage is low, and at the same time, forms a predetermined image pattern outside the image area, to promote circulation of the toner and suppress degradation of the toner.

However, in the image forming apparatus disclosed in JP 5741656 B2, in the case where the coverage is low, the predetermined image pattern is automatically formed outside the image area regardless of intention of a user. For this reason, it is not possible to confirm whether the formed image pattern overlaps the image in the image area, and the like. In addition, in a case where the user does not recognize anything about the image pattern, or in a case where an image of the image pattern differs from the user's recognition even if the user recognizes the image pattern to some extent, there is a possibility that a print result intended by the user is not obtained.

SUMMARY

The present invention has been made in view of the above problems. Therefore, an object of the present invention is to provide an image forming apparatus and a control program that can prevent or suppress that a print result intended by a user is not obtained in a case where printing is performed on long paper.

To achieve the abovementioned object, according to an aspect of the present invention, an image forming apparatus reflecting one aspect of the present invention comprises: a print job acquisitor that acquires a print job; a hardware processor that calculates, before starting printing based on the print job, a distance in a paper conveying direction in which the printing is continuously executed, and in a case where the distance is equal to or greater than a predetermined distance, allows a user to select at least one image as a print image out of a first image generated on the basis of the print job and a second image different from the first image; and a printing part that prints the print image selected by the user on paper.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
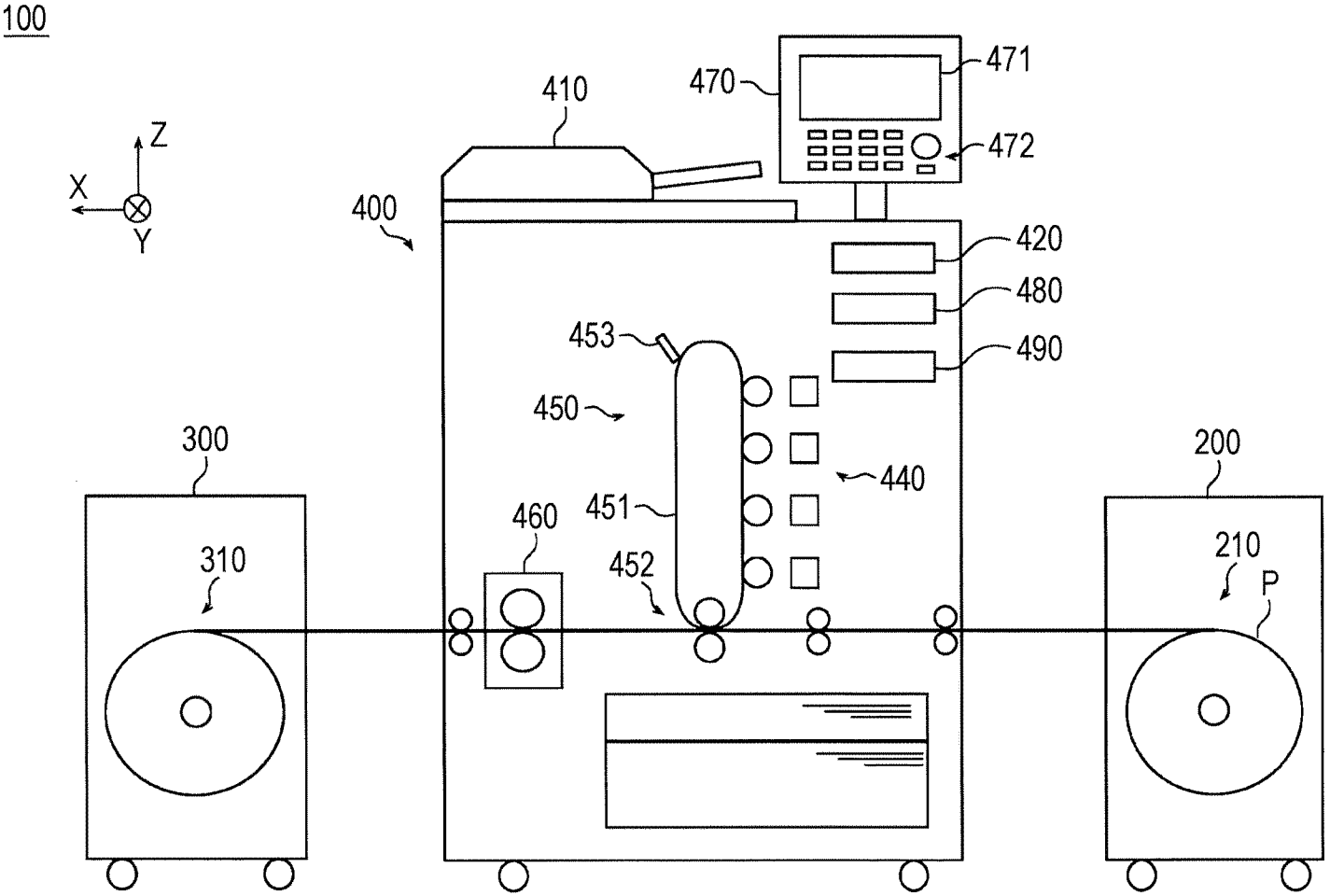
FIG. 1 is a schematic cross-sectional view illustrating a configuration of an image forming system of an embodiment.

Hereinafter, one or more embodiments of an image forming apparatus according to the present invention will be described with reference to the drawings. However, the scope of the invention is not limited to the disclosed embodiments. In the drawings, the same reference numerals are used for the same members. In addition, dimensional ratios of the drawings are exaggerated for convenience of description and may be different from actual ratios.

Embodiment

<Configuration Example of Image Forming System 100>

Figure 2:
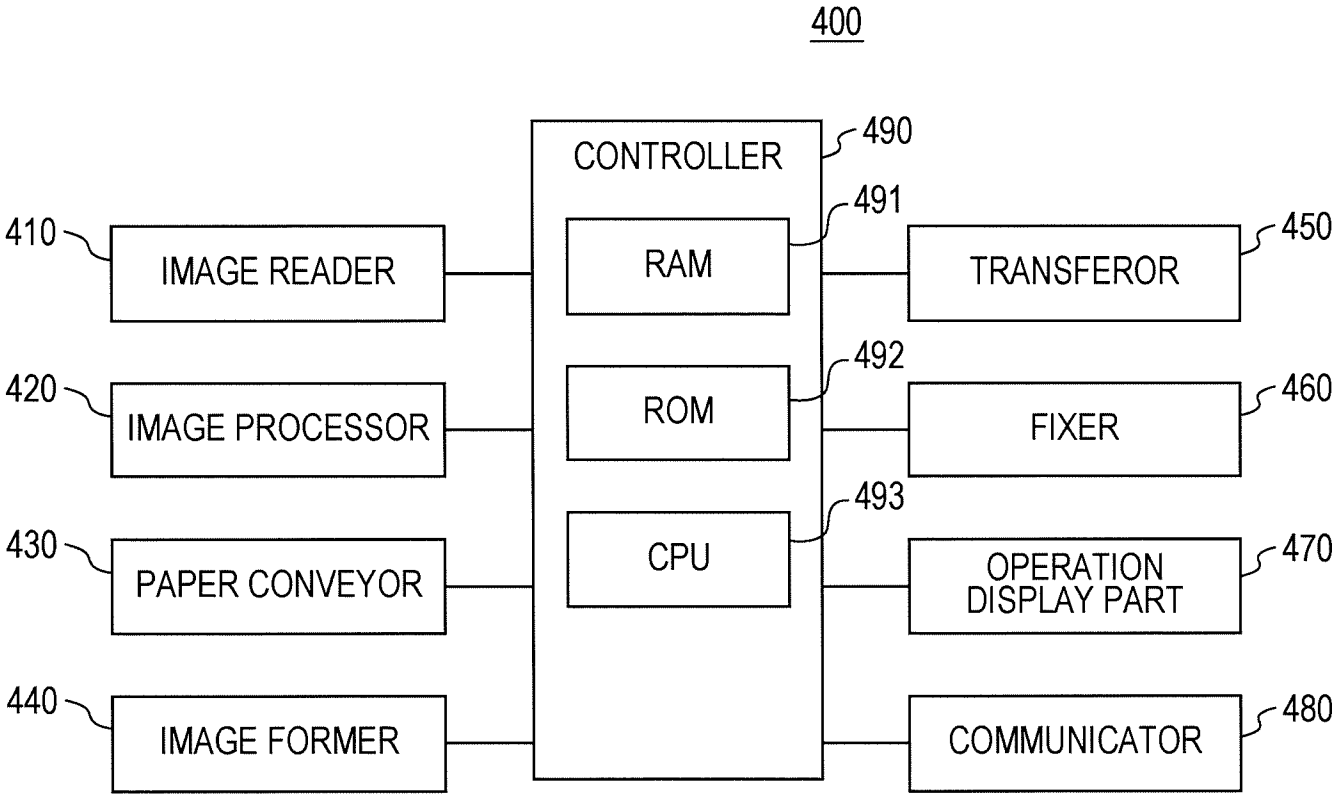
FIG. 2 is a schematic block diagram illustrating a configuration of an image forming apparatus illustrated in FIG. 1.

FIG. 1 is a schematic cross-sectional view illustrating a configuration of an image forming system 100 of an embodiment, and FIG. 2 is a schematic block diagram illustrating a configuration of an image forming apparatus 400 illustrated in FIG. 1. As illustrated in FIG. 1, the image forming system 100 forms an image on paper (continuous paper) P such as roll paper, and includes a paper feeding apparatus 200, a paper discharging apparatus 300, and the image forming apparatus 400.

The paper feeding apparatus 200 feeds the paper P to the image forming apparatus 400. The paper feeding apparatus 200 is disposed on the upstream side of the image forming apparatus 400 in a paper conveying direction X and includes a mounting part 210 including a support shaft. The mounting part 210 rotatably supports the wound paper P and feeds the paper P to the image forming apparatus 400 on the basis of a start instruction of a print job. Note that, the paper P is not necessarily held in a roll shape but may be a folded paper.

The paper discharging apparatus 300 is disposed on the downstream side of the image forming apparatus 400 in the paper conveying direction X and includes a winding part 310 including a support shaft. The winding part 310 winds the paper P discharged from the image forming apparatus 400 around the support shaft. It is not always necessary to wind the paper P in a roll shape, and it is also possible to cut and store the paper P for each page.

Between the paper feeding apparatus 200 and the image forming apparatus 400, an adjustment apparatus (buffer) may be provided for absorbing a speed difference and the like between a conveying speed of the paper P in the paper feeding apparatus 200 and a paper conveying speed of the paper P in the image forming apparatus 400. In addition, a similar adjustment apparatus may be provided between the image forming apparatus 400 and the paper discharging apparatus 300. In addition, between the image forming apparatus 400 and the paper discharging apparatus 300, a processing apparatus may be provided that performs cutting out of a label, lamination processing, or the like on the paper P on which an image is printed.

The image forming apparatus 400 is an image forming apparatus employing an electrophotographic system, and prints the image on the paper P. As illustrated in FIG. 2, the image forming apparatus 400 includes an image reader 410, an image processor 420, a paper conveyor 430, an image former 440, a transferor 450, a fixer 460, an operation display part 470, a communicator 480, and a controller 490. The image former 440, the transferor 450, and the fixer 460 function as a printing part.

The image reader 410 includes a reading sensor and an optical system including a mirror, a lens, and the like. The image reader 410 reads a document placed on a reading surface or a document conveyed by an Auto Document Feeder (ADF) to generate an image data signal, and outputs the image data signal to the image processor 420.

The image processor 420 generates print image data. The image processor 420 converts the image data signal received from the image reader 410 into digital data, performs various image processing on the digital data, and generates the print image data. In the image processor 420, for example, density correction processing, γ correction processing, filter processing, image compression processing, and the like can be performed. The generated print image data is transmitted to the image former 440.

The paper conveyor 430 conveys the paper P. For example, the paper conveyor 430 includes multiple conveying rollers, a driving motor that rotationally drives the conveying rollers, and the like, and the multiple conveying rollers are rotated by driving the drive motor, whereby the paper P fed from the paper feeding apparatus 200 is conveyed to the image former 440.

The image former 440 forms a toner image on the photosensitive drum on the basis of the print image data. The image former 440 includes an image former for yellow (Y), an image former for magenta (M), an image former for cyan (C), and an image former for black (K).

Each image former includes a cylindrical photosensitive drum, a charging part, an exposure part, and a developing part. The exposure part performs scanning in a main scanning direction with laser light on the photosensitive drum charged by the charging part, to form an electrostatic latent image on the photosensitive drum on the basis of the print image data. The electrostatic latent image is developed with toner of the developing part, and the toner image is formed.

The transferor 450 transfers the toner image to the paper P. The transferor 450 includes an intermediate transfer belt 451, a secondary transferor 452, and a cleaning part 453. The toner images of respective colors formed on the photosensitive drums by the image former 440 are transferred to be superposed onto an image forming position of the intermediate transfer belt 451. In the secondary transferor 452, the toner images of the respective colors of the intermediate transfer belt 451 are collectively transferred onto the paper P conveyed by the paper conveyor 430. The cleaning part 453 removes the toner remaining on the intermediate transfer belt 451 without being transferred onto the paper P.

The fixer 460 fixes the toner image of the paper P. The fixer 460 includes a heating roller and a pressure roller, for example, and heats and pressurizes the paper P to which the toner image has been transferred by the secondary transferor 452, to melt and fix the toner image on the surface of the paper P. The paper conveyor 430 conveys the paper P subjected to fixing by the fixer 460 to the paper discharging apparatus 300 in the subsequent stage.

The operation display part 470 includes a touch screen 471 in which a display part and an input part are combined, and an operation key 472 including a start key and a decision key provided in the periphery of the touch screen 471. The operation display part 470 displays an operation screen and accepts various kinds of information input by touch operation on the operation screen or the like or operation of the operation key 472.

The communicator 480 includes a communication interface for performing communication between the image forming apparatus 400 and a user terminal (personal computer) (not illustrated), the paper feeding apparatus 200 or the paper discharging apparatus 300. The communicator 480 functions as a print job acquisitor and acquires the print job from the user terminal.

The controller 490 controls each part of the image forming apparatus 400, the paper feeding apparatus 200, and the paper discharging apparatus 300. In addition, the controller 490 generates print image data on the basis of a print setting and print data included in the print job. The generated print image data is transmitted to the image former 440.

The controller 490 includes random access memory (RAM) 491, read only memory (ROM) 492, and a central processing unit (CPU) 493. These are mutually connected by an internal bus.

The RAM 491 stores the print job, a calculation result and determination result of the CPU 493, and the like. The ROM 492 stores a control program for controlling the image forming apparatus 400, various parameters, and the like. The CPU 493 executes the control program to control each part of the image forming apparatus 400, the paper feeding apparatus 200, and the paper discharging apparatus 300.

In the present embodiment, the controller 490 acquires the print job from the user terminal through the communicator 480, and before starting printing based on the print job, the controller 490 calculates a distance (hereinafter referred to as "print distance") in the paper conveying direction X in which the printing is continuously executed. In a case where the distance is equal to or greater than a predetermined distance, the controller 490 allows a user to select at least one image as a print image out of a first image generated on the basis of the print job and a second image different from the first image.

<Control Method of Image Forming Apparatus 400>

Figure 3:
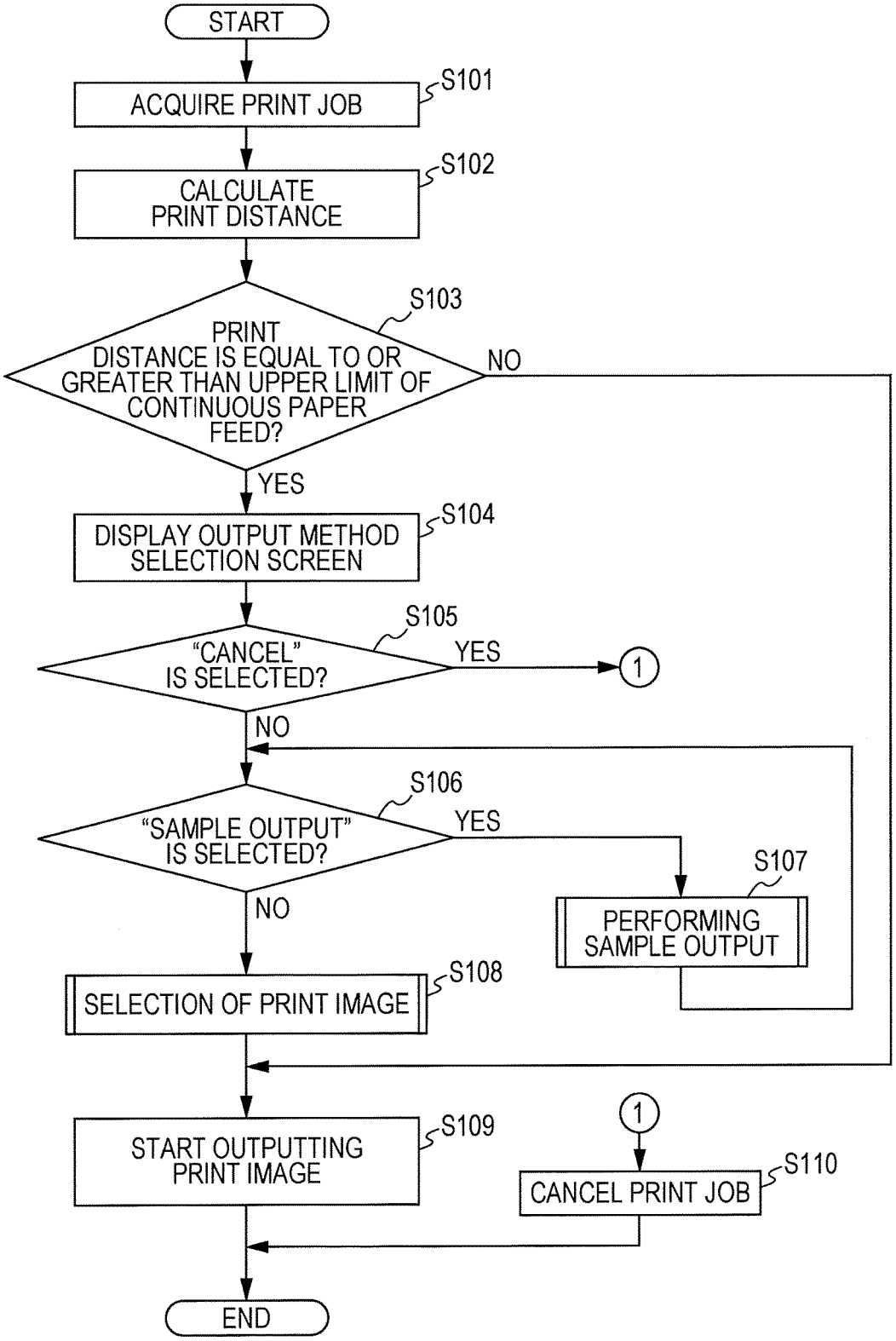
FIG. 3 is a flowchart explaining an outline of a control method of the embodiment.
Figure 4:
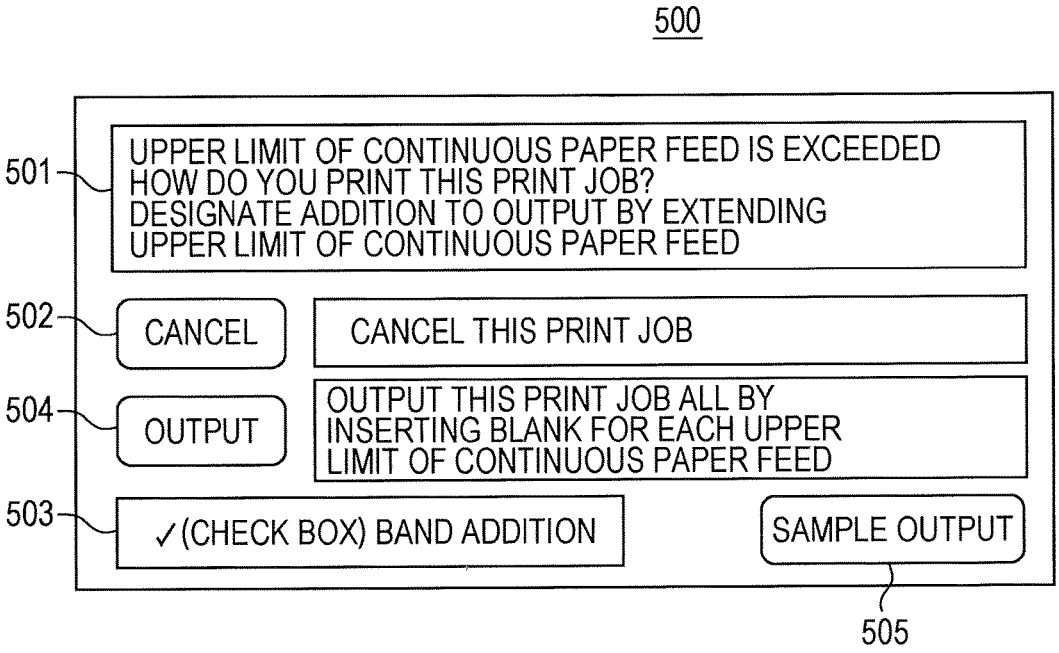
FIG. 4 is a schematic diagram illustrating an example of an output method selection screen in the embodiment.
Figure 5:
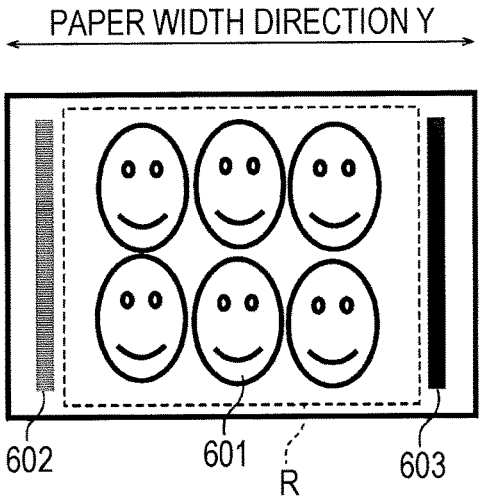
FIG. 5 is a schematic diagram illustrating a print image in which a band image is added to an original image in the embodiment.

Hereinafter, with reference to FIGS. 3 to 5, the control method of the image forming apparatus 400 of the present embodiment will be described in detail. FIG. 3 is a flowchart explaining an outline of the control method of the present embodiment, and FIG. 4 is a schematic diagram illustrating an example of an output method selection screen in the present embodiment. Processing illustrated in FIG. 3 is implemented by the CPU 493 executing the control program. In addition, FIG. 5 is a schematic diagram illustrating a print image in which a band image is added to an original image in the present embodiment.

As illustrated in FIG. 3, first, the print job is acquired (step S101). The controller 490 acquires the print job from the user terminal through the communicator 480.

Next, the print distance is calculated (step S102). The controller 490 calculates the print distance using print setting information of the print job. For example, in a case where images of a prescribed paper size are continuously printed on the paper P, the print distance is calculated on the basis of the paper size and the number of prints included in the print setting information of the print job.

Next, it is determined whether or not the print distance is equal to or greater than an upper limit of continuous paper feed (step S103). The controller 490 determines whether or not the print distance is equal to or greater than the upper limit of the continuous paper feed, that is, a distance in which the image former 440, the transferor 450, and the fixer 460 (printing part) are able to continuously print the images.

In a case where the print distance is less than the upper limit of the continuous paper feed (step S103: NO), the controller 490 starts outputting the print image (step S109). If the print distance is less than the upper limit of the continuous paper feed, since toner discharge for preventing toner degradation is not necessary, the controller 490 generates the print image data on the basis of the print setting and print data included in the print job. Subsequently, the printing part prints the print image on the paper P on the basis of the print image data. Then, the controller 490 ends the control processing (end).

On the other hand, in a case where the print distance is equal to or greater than the upper limit of the continuous paper feed (step S103: YES), the controller 490 determines that the toner discharge for preventing toner degradation is necessary and displays an output method selection screen 500 (step S104).

As illustrated in FIG. 4, the controller 490 displays the output method selection screen 500 on a display of the touch screen 471 of the operation display part 470 (hereinafter simply referred to as "display") to prompt the user to select an output method.

In a message area 501 of the selection screen 500, a message is displayed indicating that the printing by the print job exceeds the upper limit of the continuous paper feed and prompting the user to select the output method. For example, in the present embodiment, the user can select the output method from options (A) to (G) shown in Table 1 below.

TABLE 1

| Button of selection screen | Presence/absence of band addition | Output method |
|---|---|---|
| Cancel | — | (A) Cancel print job |
| Output | Presence | (B) Print print image in which band is added on paper |
| | Absence | (C) Print print image in which band is not added on paper |
| Sample output | Presence | (D) Print sample image in which band is added on paper |
| | | (E) Display sample image in which band is added on display |
| | Absence | (F) Print sample image in which band is not added on paper |
| | | (G) Display sample image in which band is not added on display |

In the selection screen 500, buttons are displayed of "cancel" 502, "✓ (check box) band addition" 503, "output" 504, and "sample output" 505. These buttons can be selected by touch operation by the user.

For example, the user can select (A) in Table 1 by touching the "cancel" 502. When the "cancel" 502 is selected, the controller 490 cancels the print job. In this case, neither the print image nor the sample image is output.

The "✓ (check box) band addition" 503 is a button for designating band addition or canceling designation of the band addition. To designate the band addition, a check is put, and to cancel the designation of the band addition, the check is removed.

When the "output" 504 is selected, the print image is printed on the paper P. In a case where the band addition is not designated, the toner discharge for preventing toner degradation (hereinafter, also simply referred to as the "toner discharge") is performed for each upper limit of the continuous paper feed, and the image of the print job is printed all. Since the toner degrades in the image forming apparatus 400, in principle, it is impossible to print beyond the upper limit of the continuous paper feed. However, when the print distance reaches the upper limit of the continuous paper feed, the toner discharge is performed, whereby the printing can be restarted.

For example, to perform the toner discharge, the controller 490 controls the image former 440 such that a color or monochrome toner image is formed by using toner whose prescribed storage period during which quality can be maintained has elapsed, in an image forming area of the photosensitive drum. Subsequently, the controller 490 performs control such that after the toner image is transferred to the intermediate transfer belt 451, the toner image on the intermediate transfer belt 451 is not transferred to the paper P in the secondary transferor 452 but is removed by the cleaning part 453.

Since the paper conveyor 430 conveys the paper P from the upstream to the downstream in the paper conveying direction X, the paper P becomes "blank" while the toner image is not transferred in the secondary transferor 452. In addition, the controller 490 performs "image correction" while the toner discharge is performed and the "blank" is inserted in the paper P. The image correction includes, for example, correction processing such as image density, gradation, and color conversion by the image processor 420.

The user can select (B) in Table 1 by selecting the "output" 504 in a state where the band addition is designated. As indicated in the message area 501, by designating the band addition, it is possible to print by extending the upper limit of the continuous paper feed.

The controller 490 performs the image correction for each extended upper limit of the continuous paper feed and prints the image of the print job. While the image correction is performed, the paper P is the "blank". The controller 490 can intermittently print the print job all by performing the image correction for each extended upper limit of the continuous paper feed.

As illustrated in FIG. 5, a "band" in the present embodiment means band images (third images) 602 and 603 for the toner discharge to be printed in a non-image forming area (for example, a paper end in a paper width direction Y) outside an image forming area R in which an original image 601 generated on the basis of the print job is printed. Note that, the "band" preferably has an elongated shape (band-like shape) for convenience of being printed outside the image forming area R; however, the band is not necessarily required to have an elongated shape and may have another shape.

By selecting the "output" 504 in a state where the band addition is not designated, (C) in Table 1 can be selected. Since the band addition is not designated, the upper limit of the continuous paper feed is not extended.

The "sample output" 505 is a button for performing sample printing of the sample image on the paper P or displaying the sample image on the display. By selecting the "sample output" 505 in the state where the band addition is designated, (D) or (E) in Table 1 can be selected. Selection of whether to print the sample image on the paper P or display the sample image on the display can be designated separately.

By selecting the "sample output" 505 without designating the band addition, (F) or (G) in Table 1 can be selected. The "sample output" 505 may be made to be selected only when the band addition is designated. In addition, the original image 601 or an image in which the band images 602 and 603 are added to the original image 601 may be output, in conjunction with the "✓ (check box) band addition" 503.

Referring back to FIG. 3, in the selection screen 500, it is determined whether or not the "cancel" 502 is selected (step S105). In a case where the "cancel" 502 is selected in the selection screen 500 (step S105: YES), the controller 490 cancels the print job (step S110). Then, the controller 490 ends the control processing (end).

On the other hand, in a case where the "cancel" 502 is not selected (step S105: NO), it is determined whether or not the "sample output" is selected (step S106). In a case where the "sample output" is selected (step S106: YES), sample output is performed (step S107). Details of performing the sample output will be described later.

On the other hand, in a case where the "sample output" is not selected (step S106: NO), the print image is selected (step S108). The controller 490 generates the original image 601 on the basis of the print job and allows the user to select at least one image as the print image out of the original image 601 and the band images 602 and 603 different from the original image 601. Details of selection of the print image will also be described later.

Next, output of the print image is started (step S109). The controller 490 starts printing the print image selected in step S108.

As described above, in the processing of the flowchart illustrated in FIG. 3, the controller 490 acquires the print job and calculates the print distance before starting printing based on the print job. Subsequently, in a case where the print distance is equal to or greater than the upper limit of the continuous paper feed, the controller 490 allows the user to select at least one image as the print image out of the original image (first image) generated on the basis of the print job and the image (second image) different from the original image. The second image is an image in which the band image (third image) is added to the original image (first image).

Therefore, in a case where the printing based on the print job is performed over a long distance, a print image to be printed on the paper P is selected by the user before the printing is started, whereby the user can recognize the print image in advance. Thus, it is possible to prevent or suppress that the print result intended by the user is not obtained in a case where printing is performed on the long paper. As a result, inadvertent printing can be prevented, and unnecessary printing, that is, waste paper can be reduced.

In addition, since the user is allowed to select whether or not to output the sample image of the print image, the user can obtain an opportunity to confirm what kind of image the print image is.

Note that, without providing the button of the "sample output" 505 on the selection screen 500, in a case where the print distance by printing of the print job is equal to or greater than the upper limit of the continuous paper feed, the sample output may be automatically performed. With this configuration, the user can easily confirm the sample image.

<Performing Sample Output>

Figure 6:
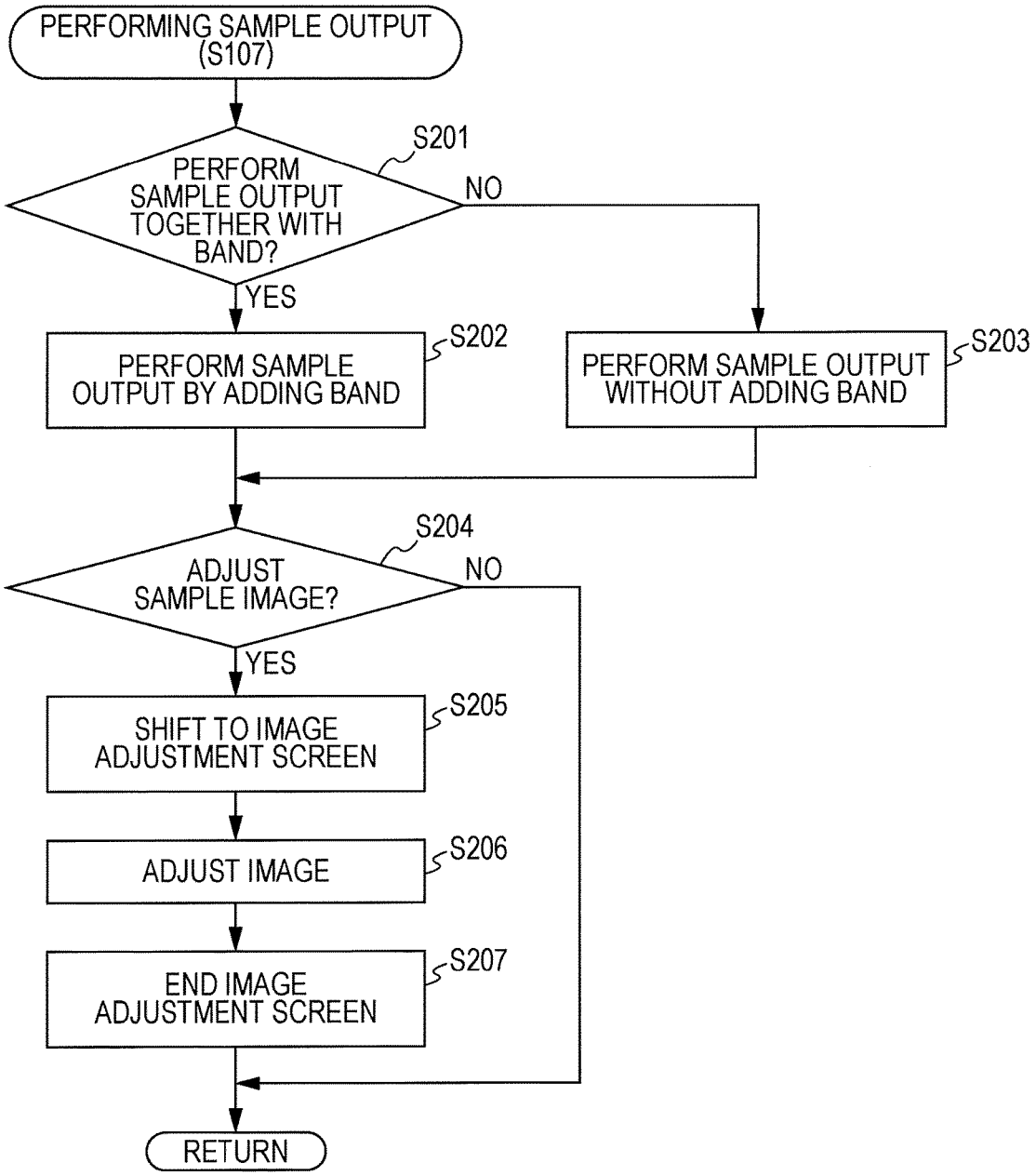
FIG. 6 is a subroutine flowchart explaining an outline of performing sample output in the flowchart of FIG. 3.

With reference to FIGS. 6 to 10D, performing sample output in the flowchart of FIG. 3 will be described in detail. FIG. 6 is a subroutine flowchart explaining an outline of performing the sample output (S107) in the flowchart of FIG. 3. Processing illustrated in FIG. 6 is implemented by the CPU 493 executing the control program. FIGS. 7A and 7B are schematic diagrams each illustrating a case where only the original image is adjusted in adjustment of the sample image. FIGS. 8A to 8D are schematic diagrams each illustrating a case where only the band image is adjusted in the adjustment of the sample image. FIGS. 9A and 9B are schematic diagrams each illustrating a case where the sample images over multiple pages are adjusted. FIGS. 10A to 10D are schematic diagrams each illustrating a case where the band image is brought to one side in the paper width direction Y in the sample images over multiple pages.

As illustrated in FIG. 6, first, it is determined whether or not sample output is to be performed together with a band (step S201). The controller 490 determines whether or not the "sample output" 505 is selected in the state where the band addition is designated. In a case where the sample output is performed together with the band (step S201: YES), the controller 490 displays a sample image in which the band images 602 and 603 are added to the original image 601 on the display or prints the sample image on the paper P (step S202).

On the other hand, in a case where the sample output is not performed together with the band (step S201: NO), the controller 490 displays the original image 601 on the display without adding the band images 602 and 603 (step S203).

The image forming apparatus 400 can output an arbitrary original image generated on the basis of the print job as the sample image. For example, in a case where the print job includes variable printing, only the leading image can be output. In a case where multiple print jobs are executed continuously, only the leading image of each print job can be output.

In addition, it is also possible to set only the band images 602 and 603 as the sample images, and display the sample images on the display or print the sample images on the paper P.

Next, it is determined whether or not to adjust the sample image (step S204). In a case where the sample image is not adjusted (step S204: NO), processing of performing the sample output is ended, and the processing returns to the processing of the flowchart of FIG. 3 (return).

On the other hand, in a case where the sample image is adjusted (step S204: YES), the processing shifts to an image adjustment screen (step S205). The user uses the touch screen 471 or the like in the image adjustment screen to adjust the sample image displayed on the display (step S206). In the present embodiment, a print position of the print image corresponding to the sample image is also adjusted in accordance with adjustment of a display position of the sample image in the display. The adjustment of the sample image is as follows, for example.

Figure 7A:
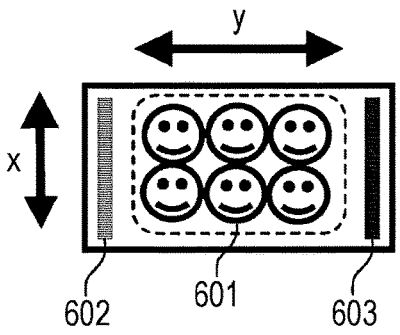
FIGS. 7A and 7B are schematic diagrams each illustrating a case where only the original image is adjusted in adjustment of a sample image.

As illustrated in FIG. 7A, the user can adjust a position of the original image 601. For example, in the image adjustment screen, the color original image 601 is displayed at a central part (a part surrounded by a broken line) in the paper width direction Y, and the color band images 602 and 603 with different colors are displayed at both ends in the paper width direction Y. The original image 601 is movable in the x direction and the y direction (see arrows), and the user can use the touch screen 471 or the like to adjust the position of the original image 601 displayed on the display independently of the band images 602 and 603.

For example, the band image 602 can be formed by superposing yellow (Y) and black (BK), and the band image 603 can be formed by superposing magenta (M) and cyan (C). Alternatively, the band image 602 can be formed by superposing magenta (M) and cyan (C), and the band image 603 can be formed by superposing yellow (Y) and black (BK). The color arrangement in the band images 602 and 603 is not limited to the above case.

Figure 7B:
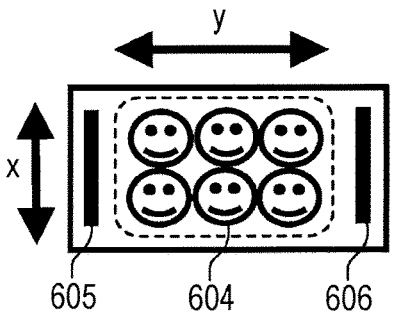

As illustrated in FIG. 7B, the user can adjust a position of an original image 604. For example, in the image adjustment screen, the monochrome original image 604 is displayed at a central part (a part surrounded by a broken line) in the paper width direction Y, and monochrome band images 605 and 606 are displayed at both ends in the paper width direction Y. The original image 604 is movable in the x direction and the y direction (see arrows), and the user can use the touch screen 471 or the like to adjust the position of the original image 604 displayed on the display independently of the band images 605 and 605.

Figure 8A:
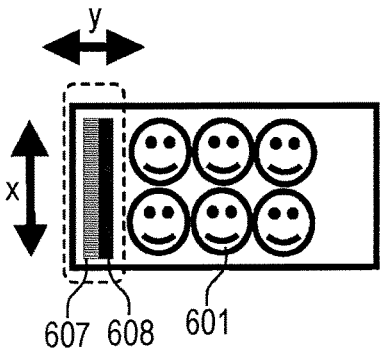
FIGS. 8A to 8D are schematic diagrams each illustrating a case where only a band image is adjusted in the adjustment of the sample image.

As illustrated in FIG. 8A, the user can adjust positions of band images 607 and 608. For example, in the image adjustment screen, the color original image 601 is displayed at the central part in the paper width direction Y, and the two color band images 607 and 608 with different colors are displayed at one end (a part surrounded by a broken line) in the paper width direction Y. That is, the band images 607 and 608 are displayed at positions left-aligned with respect to the page. The band images 607 and 608 are movable in the x direction and the y direction (see arrows), and the user can use the touch screen 471 or the like to adjust the positions of the band images 607 and 608 displayed on the display independently of the original image 601.

Figure 8B:
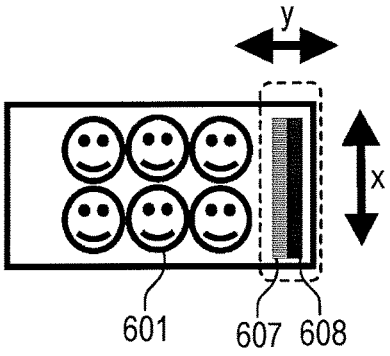

As illustrated in FIG. 8B, the user can adjust the positions of the band images 607 and 608. For example, in the image adjustment screen, the color original image 601 is displayed at the central part in the paper width direction Y, and the two color band images 607 and 608 with different colors are displayed at one end (a part surrounded by a broken line) in the paper width direction Y. That is, the band images 607 and 608 are displayed at positions right-aligned with respect to the page. The band images 607 and 608 are movable in the x direction and the y direction (see arrows), and the user can use the touch screen 471 or the like to adjust the positions of the band images 607 and 608 displayed on the display independently of the original image 601.

In FIGS. 8A and 8B, for example, the band image 607 can be formed by superposing yellow (Y) and black (BK), and the band image 608 can be formed by superposing magenta (M) and cyan (C). Alternatively, the band image 607 can be formed by superposing magenta (M) and cyan (C), and the band image 608 can be formed by superposing yellow (Y) and black (BK). The color arrangement in the band images 607 and 608 is not limited to the above case.

Figure 8C:
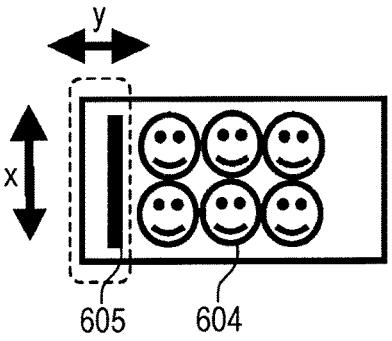

As illustrated in FIG. 8C, the user can adjust a position of the band image 605. For example, in the image adjustment screen, the monochrome original image 604 is displayed at the central part in the paper width direction Y, and the monochrome band image 605 is displayed at one end (a part surrounded by a broken line) in the paper width direction Y. That is, the band image 605 is displayed at a position left-aligned with respect to the page. The band image 605 is movable in the x direction and the y direction (see arrows), and the user can use the touch screen 471 or the like to adjust the position of the band image 605 displayed on the display independently of the original image 604.

Figure 8D:
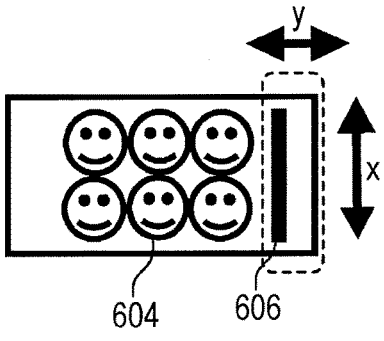

As illustrated in FIG. 8D, the user can adjust a position of the band image 606. For example, in the image adjustment screen, the monochrome original image 604 is displayed at the central part in the paper width direction Y, and the monochrome band image 606 is displayed at one end (a part surrounded by a broken line) in the paper width direction Y. That is, the band image 606 is displayed at a position right-aligned on the page. The band image 606 is movable in the x direction and the y direction (see arrows), and the user can use the touch screen 471 or the like to adjust the position of the band image 606 displayed on the display independently of the original image 604.

Figure 9B:
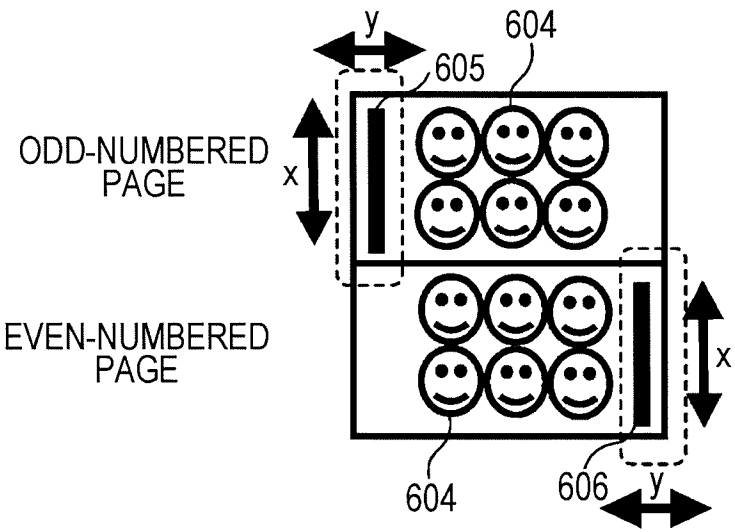
FIGS. 9A and 9B are schematic diagrams each illustrating a case where the sample images over multiple pages are adjusted.
Figure 9A:
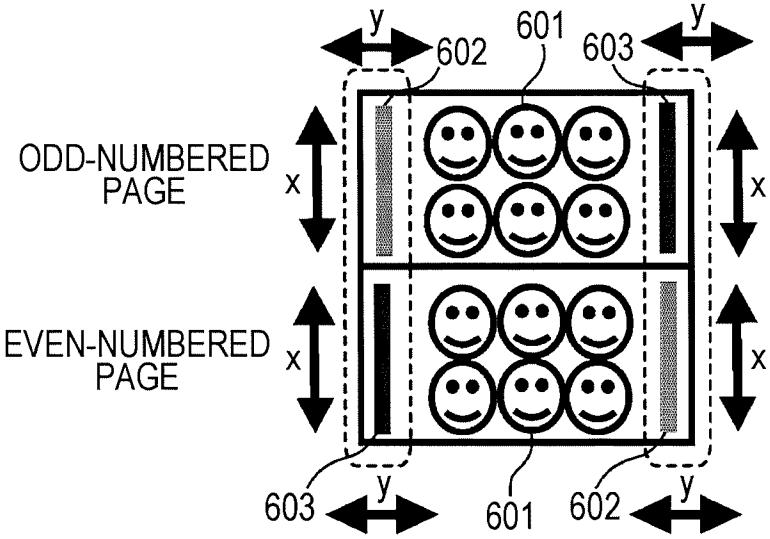

As illustrated in FIGS. 9A and 9B, it is also possible to adjust the sample images over multiple pages. In the example illustrated in FIG. 9A, color of the band image 602 is switched for each page. For example, in the odd-numbered page, the band image 602 of first color can be displayed at one end (left end) in the paper width direction Y, and the band image 603 of second color can be displayed at another end (right end). In the even-numbered page, the band image 603 of the second color is displayed at the one end (left end), and the band image 602 of the first color can be displayed at the other end (right end).

In the example illustrated in FIG. 9B, the position of the band image 605 is switched for each page. For example, in the odd-numbered page, the band image 605 is displayed at one end (left end) in the paper width direction Y, whereas the band image 605 is not displayed at another end (right end). In the even-numbered page, the band image 605 is not displayed at the one end (left end), whereas the band image 605 is displayed at the other end (right end). That is, display is performed such that the band image 605 is alternately positioned in a zigzag manner at the left end and the right end for each page. In each of FIGS. 9A and 9B, a case is illustrated where the sample images are displayed over two pages; however, the number of pages is not limited to two pages.

Figure 10B:
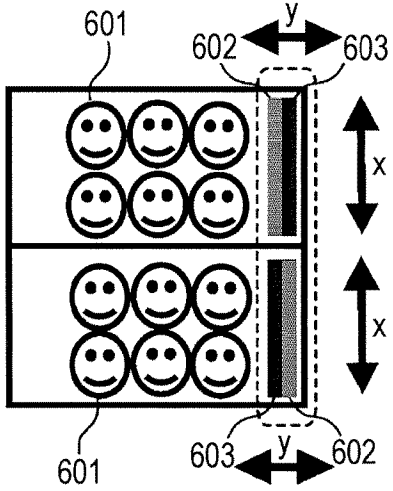
FIGS. 10A to 10D are schematic diagrams each illustrating a case where the band image is brought to one side in a paper width direction in the sample images over multiple pages.
Figure 10A:
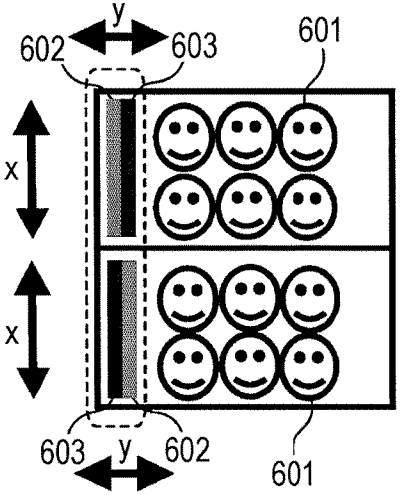

As illustrated in FIGS. 10A and 10B, it is also possible to bring the band images 602 and 603 to one side in the paper width direction Y in the sample images over multiple pages. The band images 602 and 603 are movable in the x direction and they direction (see arrows), and the user can use the touch screen 471 or the like to adjust the positions of the band images 602 and 603 displayed on the display.

In the example illustrated in FIG. 10A, colors of the band images 602 and 603 are switched for each page. For example, in the odd-numbered page, the band image 602 of the first color is displayed at the left side of one end (left end) in the paper width direction Y, and the band image 603 of the second color is displayed at the right side of the band image 602. The band image is not displayed at the other end (right end) of the odd-numbered page. In the even-numbered page, the band image 603 of the second color is displayed at the left side of the one end (left end), and the band image 602 of the first color is displayed at the right side of the band image 603. The band image is not displayed at the other end (right end) of the even-numbered page.

Also in the example illustrated in FIG. 10B, colors of the band images 602 and 603 are switched for each page. For example, in the odd-numbered page, the band image 602 of the first color is displayed at the left side of one end (right end) in the paper width direction Y, and the band image 603 of the second color is displayed at the right side of the band image 602. The band image is not displayed at the other end (left end) of the odd-numbered page. In the even-numbered page, the band image 603 of the second color is displayed at the left side of the one end (right end), and the band image 602 of the first color is displayed at the right side of the band image 603. The band image 602 is not displayed at the other end (left end) of the even-numbered page.

Figure 10D:
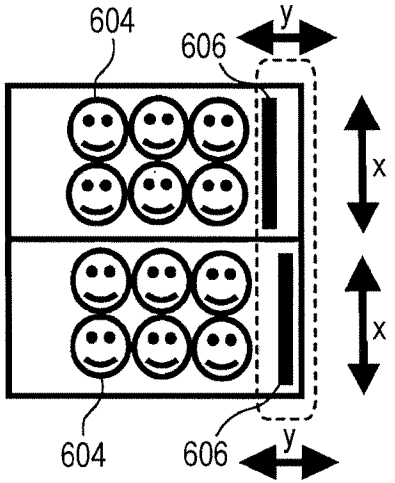
Figure 10C:
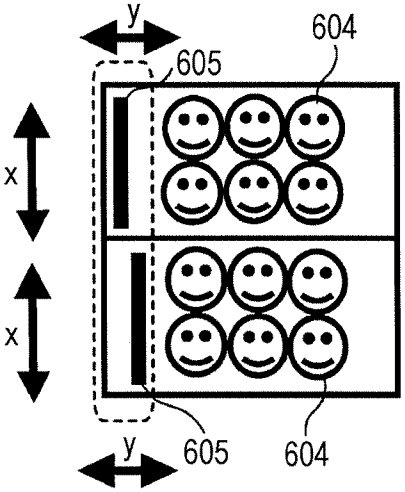

As illustrated in FIGS. 10C and 10D, it is also possible to bring the band images 605 and 606 to one side in the paper width direction Y in the sample images over multiple pages. The band images 605 and 606 are movable in the x direction and the y direction (see arrows), and the user can use the touch screen 471 or the like to adjust the positions of the band images 605 and 606 displayed on the display.

In the example illustrated in FIG. 10C, the position of the band image 605 is switched for each page. For example, in the odd-numbered page, the band image 605 is displayed at the left side of one end (left end) in the paper width direction Y, and the band image is not displayed at the right side of the band image 605. The band image is not displayed at the other end (right end) of the odd-numbered page. In the even-numbered page, the band image is not displayed at the left side of the one end (left end), and the band image 605 is displayed at the right side. The band image is not displayed at the other end (right end) of the even-numbered page. That is, at the left ends of the odd-numbered page and the even-numbered page, display is performed such that the band image 605 is alternately positioned in a zigzag manner at the left side and the right side of the left end for each page.

Also in the example illustrated in FIG. 10D, the position of the band image 606 is switched for each page. For example, in the odd-numbered page, the band image 606 is displayed at the left side of one end (right end) in the paper width direction Y, and the band image is not displayed at the right side. The band image is not displayed at the other end (left end) of the odd-numbered page. In the even-numbered page, the band image is not displayed at the left side of the one end (right end), and the band image 606 is displayed at the right side. The band image is not displayed at the other end (left end) of the even-numbered page. That is, at the right ends of the odd-numbered page and the even-numbered page, display is performed such that the band image 606 is alternately positioned in a zigzag manner at the left side and the right side of the right end for each page.

As described above, since the position at which the print image is printed on the paper P is in conjunction with the position of the sample image, the user can easily adjust the position of the print image in the paper P by adjusting the position of the sample image through the image adjustment screen.

Note that, the position, shape and number of the band images are not limited to those illustrated in FIGS. 7A, 7B, 8A to 8D, 9A, 9B, and 10A to 10D.

Next, referring back to FIG. 6, the image adjustment screen is ended (step S207). The controller 490 ends the image adjustment screen and ends the processing of performing the sample output (return).

<Selection of Print Image>

Figure 11:
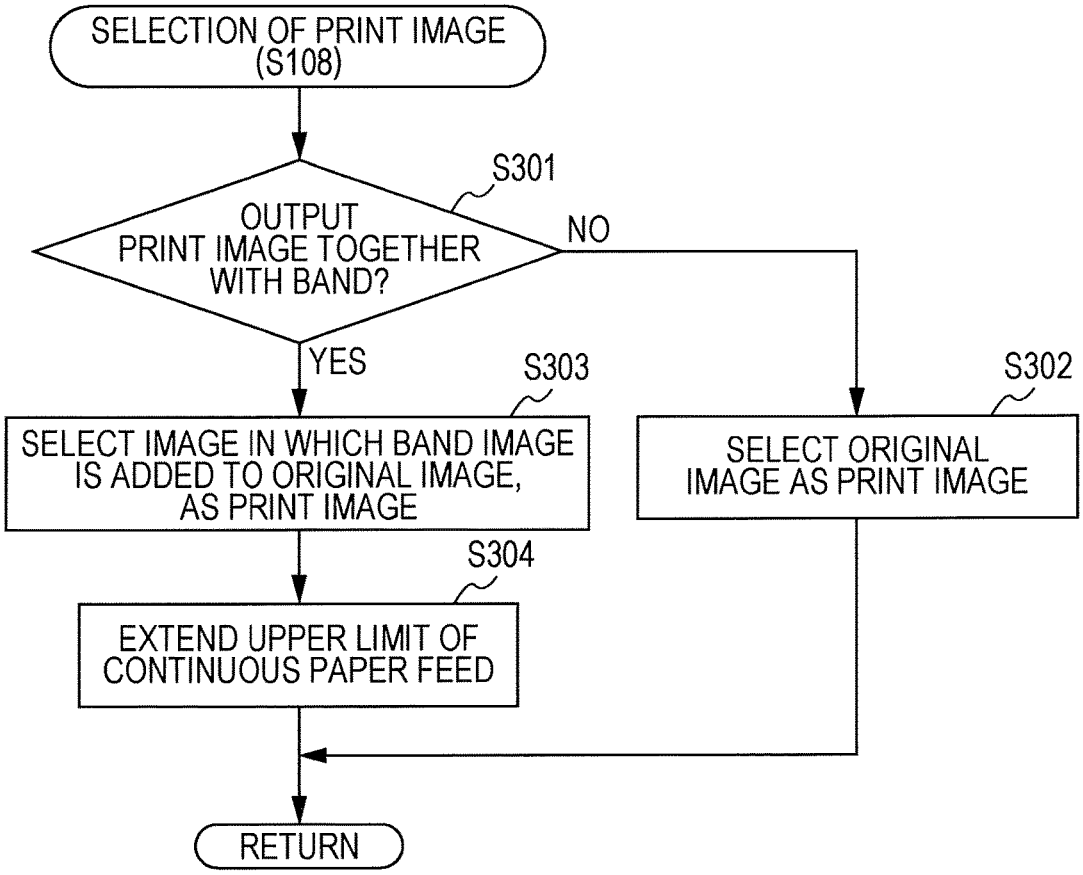
FIG. 11 is a subroutine flowchart explaining an outline of selection of the print image in FIG. 3.
Figure 12:
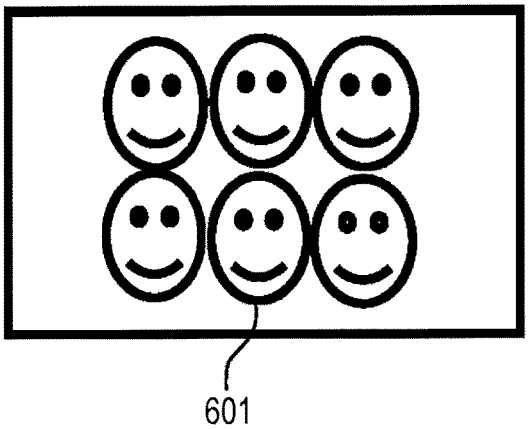
FIG. 12 is a schematic diagram illustrating a case where the original image is selected as the print image.
Figure 13:
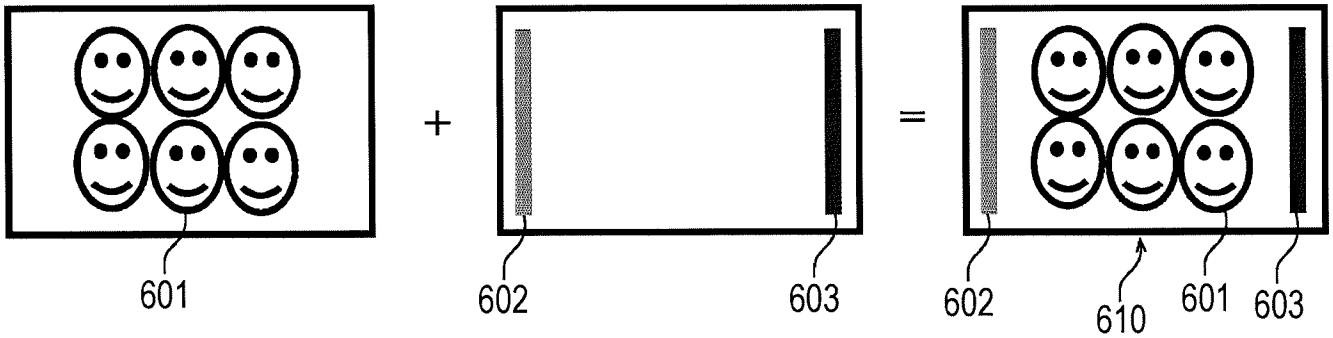
FIG. 13 is a schematic diagram illustrating a case where an image in which the band image is added to the original image is selected as the print image.

Next, with reference to FIGS. 11 to 13, selection of the print image (step S108) in the flowchart of FIG. 3 will be described in detail. FIG. 11 is a subroutine flowchart explaining an outline of the selection of the print image (S108) in the flowchart of FIG. 3, and FIG. 12 is a schematic diagram illustrating a case where the original image 601 is selected as the print image. In addition, FIG. 13 is a schematic diagram illustrating a case where the image in which the band images 602 and 603 are added to the original image 601 is selected as the print image.

As illustrated in FIG. 11, first, it is determined whether or not to output the print image together with the band (step S301). The controller 490 determines whether or not the "output" 504 is selected in the state where the band addition is designated. In a case where the print image is not output together with the band, that is, in a case where the "output" 504 is selected in the state where the band addition is not designated (step S301: NO), as illustrated in FIG. 12, the original image 601 is selected as the print image (step S302). Then, the controller 490 ends processing of selecting the print image (return).

On the other hand, in a case where the print image is output together with the band (step S301: YES), as illustrated in FIG. 13, the controller 490 selects, for example, the image in which the band images 602 and 603 are added to the original image 601, as the print image (step S303). The controller 490 generates a print image 610 in which the band images 602 and 603 are added to the original image 601. At this time, the print job acquired from the user terminal by the controller 490 is held in the RAM 491 in its initial state.

Next, the upper limit of the continuous paper feed is extended (step S304). In a case where the print image is printed together with the band, the controller 490 changes the upper limit of the continuous paper feed to a distance longer than the initial predetermined distance. By changing the upper limit of the continuous paper feed to the distance longer than the initial predetermined distance, the image forming apparatus 400 can print the image on the paper P over a longer distance than before. Then, the controller 490 ends the processing of selecting the image (return).

<Operation Example of Image Forming Apparatus 400>

Figure 14:
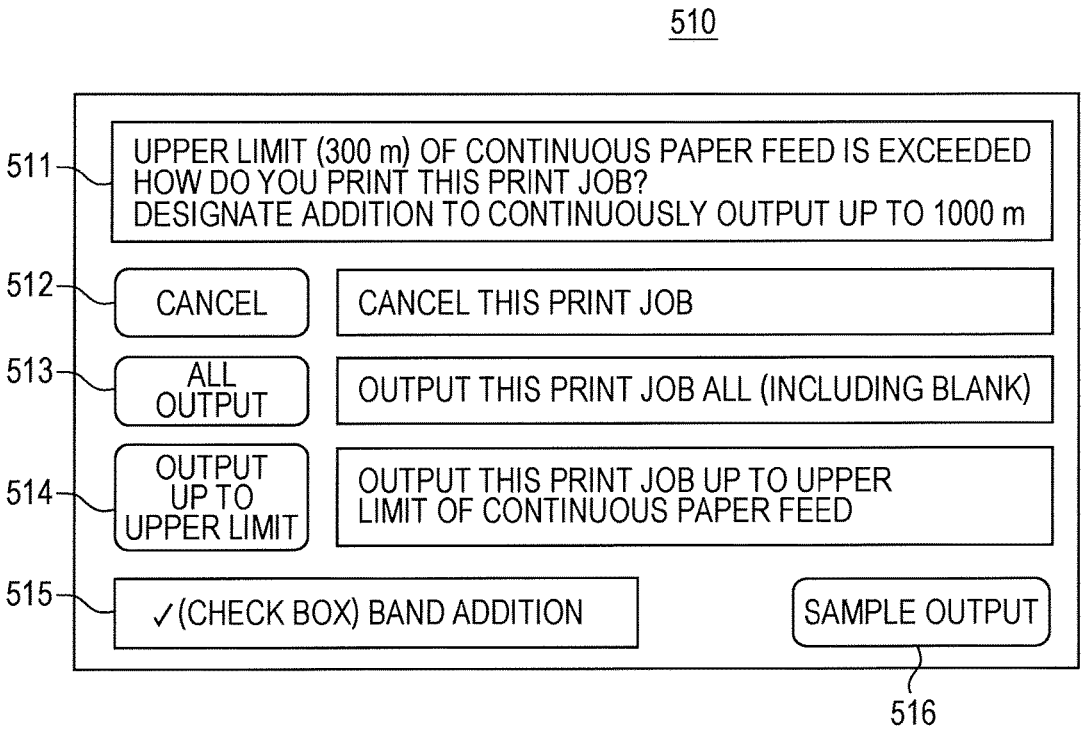
FIG. 14 is a schematic diagram illustrating a preferred example of the output method selection screen in the image forming apparatus.
Figure 15:
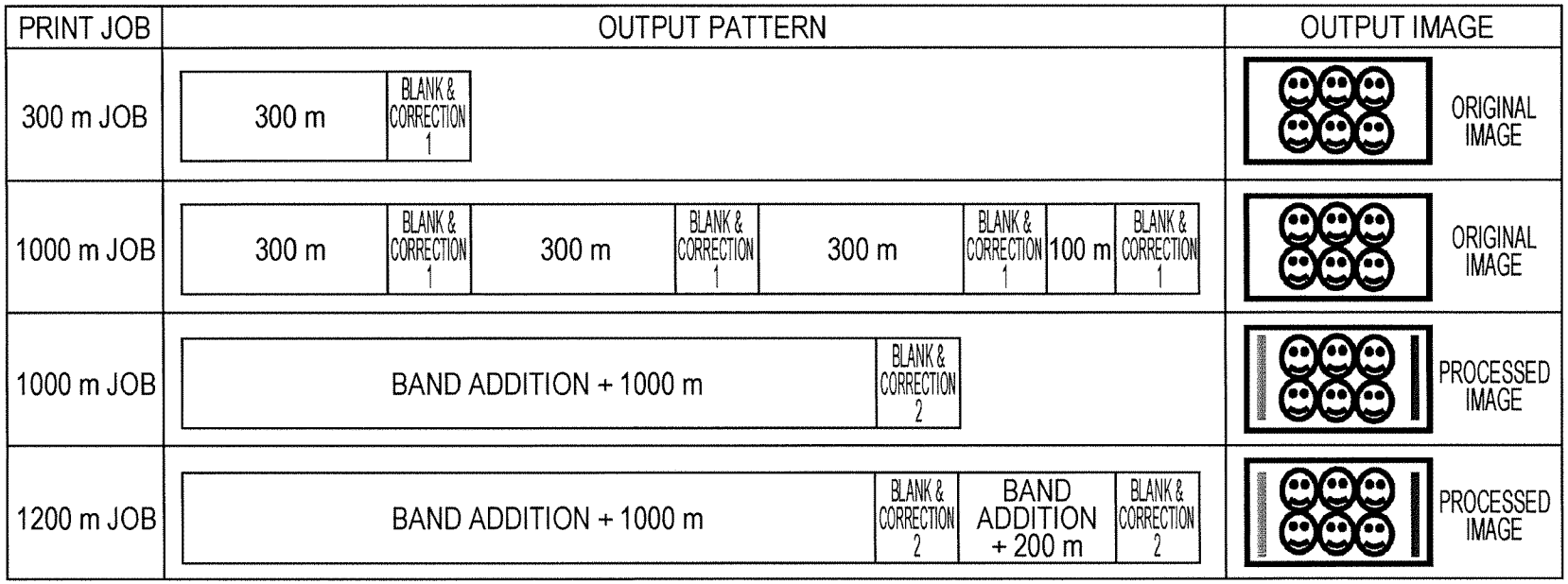
FIG. 15 is a schematic diagram illustrating an output pattern of the image forming apparatus.

An operation example of the image forming apparatus 400 will be described below with reference to FIGS. 14 and 15. FIG. 14 is a schematic diagram illustrating a preferred example of the output method selection screen in the image forming apparatus 400, and FIG. 15 is a schematic diagram illustrating an output pattern of the image forming apparatus 400.

As illustrated in FIG. 14, in a case where the print distance of the acquired print job is equal to or greater than the upper limit of the continuous paper feed, the image forming apparatus 400 displays an output method selection screen 510 on the display.

In a message area 511 of the selection screen 510, a message is displayed indicating that the print distance by the print job exceeds the upper limit (300 m) of the continuous paper feed and prompting the user to select the output method. As will be described below, in the present operation example, in a case where the band addition is designated, the upper limit of the continuous paper feed is extended from 300 m to 1000 m, and printing up to 1000 m can be continuously performed.

The selection screen 510 includes buttons of "cancel" 512, "output all" 513, "output up to upper Limit" 514, "✓ (check box) band addition" 515, and "sample output" 516, and these buttons can be selected by touch operation by the user.

The "cancel" 512, the "✓ (check box) band addition" 515, and the "sample output" 516 respectively have the same functions as the "cancel" 502, the "✓ (check box) band addition" 503, and the "sample output" 505 on the output method selection screen 500 in FIG. 4. Therefore, detailed explanation will be omitted of functions of the "cancel" 512, the "✓ (check box) band addition" 515, and the "sample output" 516.

In a case where the "output all" 513 is selected in the state where the band addition is not designated, the controller 490 performs the toner discharge and the image correction for each time when the upper limit (300 m) of the continuous paper feed is exceeded, and prints the print job all.

As illustrated in FIG. 15, for example, in a case where the print distance of the print job is just 300 m, immediately after 300 m printing, the toner discharge is performed, and the image correction is performed. In FIG. 15, "blank & correction 1" means that the "blank" is inserted onto the paper P, and the toner discharge and the image correction are performed.

In a case where the print distance of the print job is 1000 m, the controller 490 repeats three times a process of performing the toner discharge and the image correction immediately after 300 m printing. Further, immediately after 100 m printing, the controller 490 performs the toner discharge and the image correction. The print image to be printed on the paper P is the original image 601.

In a case where the "output up to upper limit" 514 is selected in the state where the band addition is not designated, the controller 490 prints the print job up to the upper limit (300 m) of the continuous paper feed, and then performs the toner discharge and the image correction. The print image to be printed on the paper P is the original image 601.

In a case where the "output all" 513 is selected in the state where the band addition is designated, the controller 490 performs the image correction immediately after the extended upper limit (1000 m) of the continuous paper feed is exceeded, and prints the print job all. The print image to be printed on the paper P is the image in which the band images 602 and 603 are added to the original image 601 (also referred to as "processed image"). In FIG. 15, "blank & correction 2" means that the "blank" is inserted onto the paper P and the image correction is performed.

In a case where the "output up to upper limit" 514 is selected in the state where the band addition is designated, the controller 490 performs the image correction immediately after the extended upper limit (1000 m) of the continuous paper feed is exceeded. Further, the controller 490 performs the image correction immediately after 200 m printing. The print image to be printed on the paper P is the processed image.

<Another Operation Example of Image Forming Apparatus 400>

Figure 16:
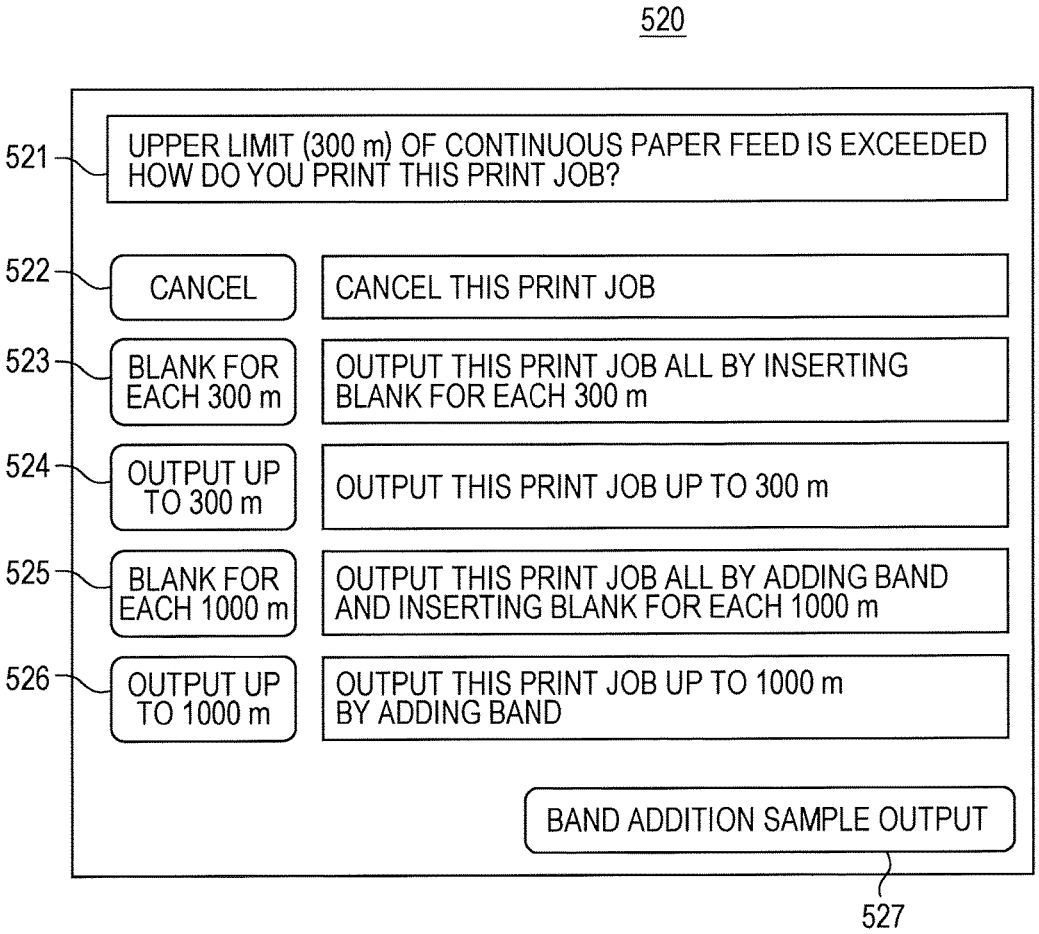
FIG. 16 is a schematic diagram illustrating another preferred example of the output method selection screen in the image forming apparatus.

FIG. 16 is a schematic diagram illustrating another preferred example of the output method selection screen in the image forming apparatus 400. In a case where the print distance of the acquired print job is equal to or greater than the upper limit of the continuous paper feed, the image forming apparatus 400 displays an output method selection screen 520 on the display.

In a message area 521, a message is displayed indicating that the print distance of the print job exceeds the upper limit (300 m) of the continuous paper feed and prompting the user to select the output method. Also in the present operation example, in the case where the band addition is designated, the upper limit of the continuous paper feed is extended from 300 m to 1000 m, and printing up to 1000 m can be continuously performed.

The selection screen 520 includes buttons of "cancel" 522, "blank for each 300 m" 523, "output up to 300 m" 524, "blank for each 1000 m" 525, "output up to 1000 m" 526, and "band addition sample output" 527. These buttons can be selected by touch operation by the user.

The "cancel" 522 has the same function as the "cancel" 502 on the output method selection screen 500 in FIG. 4. Therefore, detailed description is omitted of the function of the "cancel" 522.

When the "blank for each 300 m" 523 is selected, the blank is inserted onto the paper P for each 300 m, and the print job is printed all. While the blank is inserted, the toner discharge and the image correction are performed.

When the "output up to 300 m" 524 is selected, printing is performed up to 300 m that is the upper limit of the continuous paper feed.

When the "blank for each 1000 m" 525 is selected, the band is added to the print job and the upper limit of the continuous paper feed is extended to 1000 m, and the blank is inserted for each 1000 m and the print job is printed all. While the blank is inserted, the image correction is performed.

When the "output up to 1000 m" 526 is selected, the band is added to the print job and the upper limit of the continuous paper feed is extended to 1000 m, and printing is performed up to 1000 m.

When the "band addition sample output" 527 is selected, the sample image in which the band images 602 and 603 are added to the original image 601 is displayed in the display, or printed on the paper P.

<Example of Print Sequence during Sample Printing>

Figure 17:
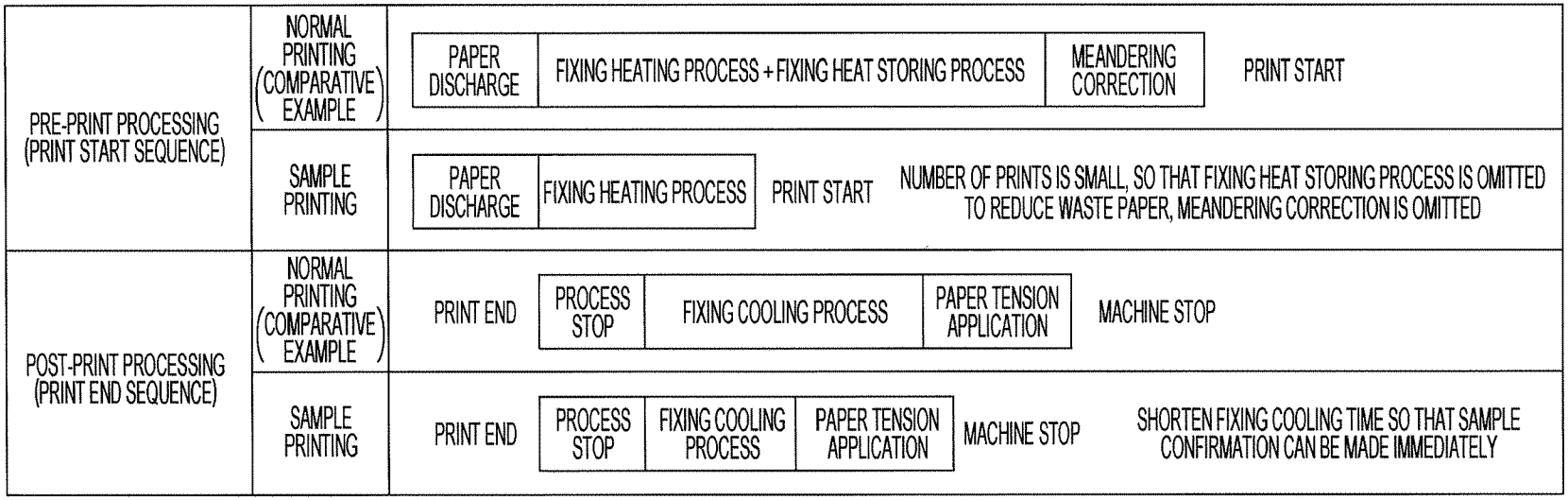
FIG. 17 is a schematic diagram illustrating a print sequence during sample printing in the embodiment.

FIG. 17 is a schematic diagram illustrating a print sequence during sample printing in the present embodiment. In pre-print processing (print start sequence) of normal printing (comparative example), after the paper in a machine is discharged, a fixing heating process, a fixing heat storing process, and meandering correction are performed before the printing is started. In the fixing heat storing process, the heating roller is heated at a constant temperature for a given time to store heat so that fixing temperature does not decrease even if output is performed in a long distance. The meandering correction is a process of correcting meandering of the paper P by feeding blank paper.

In pre-print processing of sample printing of the present embodiment, after the paper in the machine is discharged, only the fixing heat storing process is performed before the printing is started. Since the meandering correction is not performed, feeding of the blank paper is omitted, so that the waste paper can be reduced. Further, the number of prints is small at the time of sample confirmation, so that the fixing heat storing process is omitted and only the fixing heating process is performed, whereby the time can be shortened compared to that at the time of normal printing. In this way, the pre-print processing is simplified.

In post-print processing (print end sequence), after the printing ends, a process is stopped before the machine is stopped, and the fixing cooling process is performed, and then tension is applied to the paper P. In the fixing cooling process, the fixer 460 is cooled by a cooling fan.

In the post-print processing of sample printing of the present embodiment, compared to the post-print processing of the normal printing (comparative example), the time can be shortened for performing fixing cooling. Thus, the sample image can be quickly confirmed before the paper P on which the sample image is printed is conveyed to the paper discharging apparatus 300. In this way, the post-print processing is simplified.

As described above, in the embodiment, the image forming apparatus and the control program of the present invention have been described. However, it goes without saying that those skilled in the art can appropriately add, modify, and omit the present invention within the scope of the technical idea.

For example, in the above-described embodiment, a case has been described where the user is allowed to select whether or not to output the sample image of the print image and then the user is allowed to select the print image. However, the present invention is not limited to such a case and may be configured such that the user is allowed to select the print image and then the user is allowed to select whether or not to output the sample image of the print image.

The control program may be provided by a computer-readable recording medium such as a USB memory, a flexible disk, a CD-ROM, or the like, or may be provided online via a network such as the Internet. In this case, the program recorded in the computer-readable recording medium is usually transferred to and stored in a memory, a storage, or the like. In addition, the control program may be provided, for example, as single application software, or may be incorporated into software of each apparatus as one function of the image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a print job acquisitor that acquires a print job;

a hardware processor that calculates, before starting printing based on the print job, a distance in a paper conveying direction in which the printing is continuously executed, and in a case where the distance is equal to or greater than a predetermined distance, allows a user to select at least one image as a print image out of a first image generated on the basis of the print job and a second image different from the first image; and a printing part that prints the print image selected by the user on paper.

2. The image forming apparatus according to claim 1, wherein the hardware processor allows the user to select whether or not to output a sample image of the print image.

3. The image forming apparatus according to claim 1, wherein the hardware processor outputs a sample image of the print image before allowing the user to select the print image.

4. The image forming apparatus according to claim 3, wherein the hardware processor controls the printing part such that the sample image of the print image is printed on the paper during output of the sample image.

5. The image forming apparatus according to claim 3, further comprising a display part, wherein the hardware processor controls the display part such that the sample image of the print image is displayed during output of the sample image.

6. The image forming apparatus according to claim 1, wherein the predetermined distance is set to a distance in which the printing part is able to continuously print an image.

7. The image forming apparatus according to claim 1, wherein the second image is an image in which a third image is added to the first image.

8. The image forming apparatus according to claim 6, wherein the hardware processor extends the distance in which the printing part is able to continuously print the image in a case where the second image is selected as the print image.

9. The image forming apparatus according to claim 4, wherein the hardware processor simplifies pre-print processing to be performed before starting printing of the sample image.

10. The image forming apparatus according to claim 4, wherein the hardware processor simplifies post-print processing to be performed after ending the printing of the sample image.

11. The image forming apparatus according to claim 7, wherein a position at which the print image is printed on the paper can be adjusted by the user.

12. The image forming apparatus according to claim 11, wherein positions at which the first image and the third image are printed on the paper can be adjusted separately from each other in a case where the third image is included in the print image.

13. The image forming apparatus according to claim 11, wherein the position at which the print image is printed on the paper can be adjusted by the user while the print job is kept in an initial state where the print job is acquired.

14. The image forming apparatus according to claim 4, wherein an arbitrary image generated on the basis of the print job can be output as the sample image.

15. The image forming apparatus according to claim 6, wherein the hardware processor, in a case where a distance printed continuously on the paper by the printing part exceeds the predetermined distance, inserts a blank in the paper and performs image correction.

16. The image forming apparatus according to claim 1, wherein the printing part employs an electrophotographic system.

17. The image forming apparatus according to claim 7, wherein the hardware processor prints the first image in an image forming area and prints the third image in a non-image forming area.

18. A non-transitory recording medium storing a computer readable control program causing a computer to execute:

(a) acquiring a print job;

(b) calculating a distance in a paper conveying direction in which printing based on the print job is continuously executed, and in a case where the distance is equal to or greater than a predetermined distance, allowing a user to select at least one image as a print image out of a first image generated on the basis of the print job and a second image different from the first image; and (c) printing the print image selected by the user on paper.

19. The non-transitory recording medium storing a computer readable control program according to claim 18, further causing a computer to execute:

after (a), (d) allowing the user to select whether or not to output a sample image of the print image.

20. The non-transitory recording medium storing a computer readable control program according to claim 18, further causing a computer to execute:

after (a) and before (b), (e) outputting a sample image of the print image.

* * * * *